US007626159B2

(12) United States Patent
D'Annunzio

(10) Patent No.: US 7,626,159 B2
(45) Date of Patent: Dec. 1, 2009

(54) MAGAZINE FOR PRINTING AND CONVERTING HEADS, PARTICULARLY FOR PRINTING MACHINES

(75) Inventor: Federico D'Annunzio, Cislago (IT)

(73) Assignee: Gidue S.p.A., Turate (IT)

( * ) Notice: Subject to any disclaimer, the term of this patent is extended or adjusted under 35 U.S.C. 154(b) by 0 days.

(21) Appl. No.: 11/907,306

(22) Filed: Oct. 11, 2007

(65) Prior Publication Data

US 2008/0110361 A1 May 15, 2008

(30) Foreign Application Priority Data

Nov. 10, 2006 (IT) ..... MI06A2162

(51) Int. Cl.
*B41F 27/12* (2006.01)
*G06M 7/00* (2006.01)

(52) U.S. Cl. ..... 250/223 R; 250/234; 101/477; 101/44

(58) Field of Classification Search ..... 250/234, 250/223 R; 101/477, 43–44; 347/85, 86
See application file for complete search history.

(56) References Cited

U.S. PATENT DOCUMENTS

| | | | | |
|---|---|---|---|---|
| 4,738,199 | A * | 4/1988 | Chen | 101/163 |
| 5,060,569 | A | 10/1991 | Gladow | |
| 5,697,297 | A | 12/1997 | Rasmussen | |
| 5,794,531 | A | 8/1998 | Keller | |
| 5,901,644 | A * | 5/1999 | Etheridge et al. | 101/71 |
| 6,802,252 | B1 * | 10/2004 | Maggio | 101/153 |
| 7,033,004 | B2 * | 4/2006 | Ghisalberti et al. | 347/85 |

FOREIGN PATENT DOCUMENTS

| | | |
|---|---|---|
| DE | 197 36 698 A1 | 2/1999 |
| DE | 10 2004 0216A B3 | 5/2005 |

* cited by examiner

*Primary Examiner*—Kevin Pyo
(74) *Attorney, Agent, or Firm*—Modiano & Associati; Albert Josif; Daniel J. O'Byrne

(57) ABSTRACT

A magazine for printing and converting heads for printing machines, comprising at least one containment body which is adapted to be arranged in close proximity to a printing machine and is adapted to accommodate a plurality of printing and converting heads, a carriage being provided for conveying the printing and converting heads from the at least one containment body to the printing machine and from the printing machine to the at least one containment body.

6 Claims, 1 Drawing Sheet

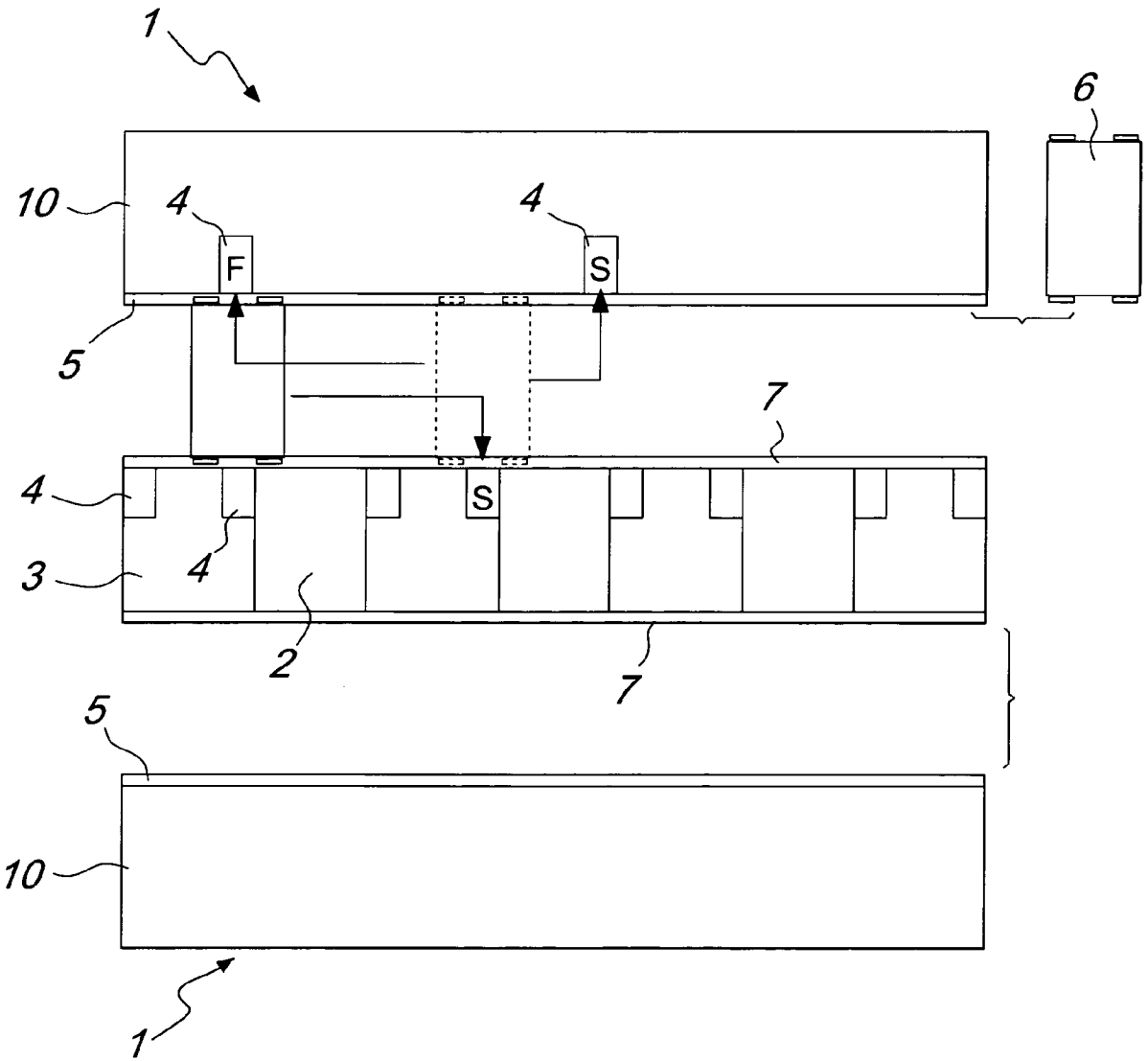
6
1
10
5
4
F
S
4
7
S
4
3
2
7
5
10
1

MAGAZINE FOR PRINTING AND CONVERTING HEADS, PARTICULARLY FOR PRINTING MACHINES

The present invention relates to a magazine for printing and converting heads for printing machines. More particularly, the invention relates to a magazine for printing and converting heads for flexographic, screen, offset, gravure, hot stamping, die-cutting, lamination printing machines and the like.

BACKGROUND OF THE INVENTION

As is known, printing machines, in order to be switched from one type of printing to another, must allow to replace the printing and converting heads with the heads adapted for each type of printing. This operation entails the need to have the printing and converting heads available in a location which is close to the printing machine, in order to change the heads when needed.

However, it seems extremely inefficient to be able to store the printing and converting heads in the vicinity of the machine without causing the operator problems of space occupation around the machine proper and without making it awkward to reach the printing and converting heads in order to allow quick changing of the printing head.

SUMMARY OF THE INVENTION

The aim of the present invention is to provide a magazine for printing and converting heads particularly for printing machines which allows to store the printing and converting heads close to the printing machine and allows to arrange them in an operating condition in a short time.

Within this aim, an object of the present invention is to provide a magazine for printing and converting heads which allows the heads stored therein to be conveyed to the operating position in an automated manner and without causing hindrance to the operators.

Another object of the present invention is to provide a magazine for printing and converting heads which can be arranged both in front and above with respect to the printing machine.

Still another object of the present invention is to provide a magazine for printing and converting heads which is highly reliable, relatively simple to provide and at competitive costs.

This aim and these and other objects, which will become better apparent hereinafter, are achieved by a magazine for printing and converting heads for printing machines, characterized in that it comprises at least one containment body which is adapted to be arranged in close proximity to said printing machine and is adapted to accommodate a plurality of printing and converting heads, conveyance means being provided for conveying said printing and converting heads from said at least one containment body to said printing machine and from said printing machine to said at least one containment body.

BRIEF DESCRIPTION OF THE INVENTION

Further characteristics and advantages of the invention will become better apparent from the description of preferred but not exclusive embodiments of the magazine according to the present invention, illustrated by way of a non-limiting example in the accompanying drawings, wherein the only FIGURE is a schematic view of a printing machine with a magazine according to the present invention.

DESCRIPTION OF THE PREFERRED EMBODIMENTS

With reference to the FIGURE, the magazine according to the present invention, generally designated by the reference numeral 1 comprises at least one containment body 10 adapted to be arranged in close proximity to a printing machine 2, which is provided with a plurality of printing units 3, each provided with at least one, and preferably two, printing and converting heads 4.

Conveniently, the magazine is provided with at least one rail 5 which allows the engagement of conveyance means 6, conveniently constituted by at least one carriage, which engages the rail 5 and a facing rail 7 arranged at the printing machine 2.

Substantially, therefore, the magazine 1 contains a plurality of printing and converting heads 4, which when needed are loaded onto the carriage 6 in order to be conveyed from the magazine 1 to the printing machine 2.

The carriage 6 thus moves from an inactive position, in which it is substantially aligned with the magazine 1, to an active position, in which it is located between the magazine 1 and the printing machine 2, with the printing and converting heads 4 loaded onto the carriage. The carriage therefore allows to move the printing and converting heads 4 from the carriage 6 to the printing machine 2 and vice versa from the printing machine to the carriage, to be thus repositioned within the magazine 1.

The magazine 1 can be arranged both frontally with respect to the printing machine and in an overhead position above said printing machine.

In both cases, operation is similar to what has been described above, the printing and converting heads passing from the magazine to the printing machine 2 by using the carriage 6.

Conveniently, there can be at least one magazine 1 and optionally two magazines, one for each side of the printing machine 2, or one arranged at the front and one arranged in an overhead position.

According to another alternative, the magazine 1 can be arranged below the printing machine 2.

The invention also relates to a printing machine with a corresponding magazine according to what has been described above.

In practice it has been found that the magazine according to the invention fully achieves the intended aim and objects, since it allows to load the printing and converting heads which must be interchanged on the various printing units of the printing machine efficiently, with extremely small space occupations, and most of all without any operating problem for the operators of the printing machine.

The magazine thus conceived is susceptible of numerous modifications and variations, all of which are within the scope of the appended claims; all the details may further be replaced with other technically equivalent elements.

In practice, the materials used, as well as the contingent shapes and dimensions, may be any according to requirements and to the state of the art.

The disclosures in Italian Patent Application No. MI2006A002162 from which this application claims priority are incorporated herein by reference.

What is claimed is:

1. A magazine for printing and converting heads for printing machines comprising at least one containment body which is adapted to be arranged in close proximity to a printing machine and is adapted to accommodate a plurality of printing and converting heads, conveyance means being provided for conveying said printing and converting heads from said at least one containment body to said printing machine and from said printing machine to said at least one containment body, wherein said at least one containment body is provided with a rail which is adapted to face a corresponding rail which is defined on said printing machine, and wherein said conveyance means comprises at least one carriage which is adapted to engage between said rail of said at least one containment body and said rail of said printing machine.

2. The magazine according to claim 1, wherein said at least one containment body is arranged in a front position with respect to said printing machine.

3. The magazine according to claim 1, wherein said at least one containment body is arranged in a rear position with respect to said printing machine.

4. The magazine according to claim 1, wherein said at least one containment body is arranged above said printing machine.

5. A printing machine, comprising at least one magazine according to claim 1.

6. The printing machine according to claim 5, wherein said printing machine is a flexographic, screen, offset, gravure, hot stamping, die-cutting lamination printing machine.

* * * * *